US011629514B2

(12) United States Patent
Foley et al.

(10) Patent No.: US 11,629,514 B2
(45) Date of Patent: Apr. 18, 2023

(54) WORK PLATFORM

(71) Applicant: Tricam Industries, Inc., Eden Prairie, MN (US)

(72) Inventors: Joseph P. Foley, St. Paul, MN (US); Dennis D. Simpson, Plymouth, MN (US); Benjamin P. Williams, Chaska, MN (US)

(73) Assignee: Tricam Industries, Inc., Eden Prairie, MN (US)

( * ) Notice: Subject to any disclaimer, the term of this patent is extended or adjusted under 35 U.S.C. 154(b) by 0 days.

(21) Appl. No.: 17/171,839

(22) Filed: Feb. 9, 2021

(65) Prior Publication Data

US 2021/0164243 A1 Jun. 3, 2021

Related U.S. Application Data

(63) Continuation of application No. 16/253,837, filed on Jan. 22, 2019.

(Continued)

(51) Int. Cl.
*E04G 1/34* (2006.01)
*E04G 1/30* (2006.01)

(Continued)

(52) U.S. Cl.
CPC ..... *E04G 1/34* (2013.01); *E04C 1/39* (2013.01); *E04G 1/30* (2013.01); *E04G 1/32* (2013.01); *E04G 2001/307* (2013.01)

(58) Field of Classification Search
CPC .... E04G 1/34; E04G 1/30; E04G 1/32; E04G 2001/307; E04C 1/39
See application file for complete search history.

(56) References Cited

U.S. PATENT DOCUMENTS 1,133,109 A 3/1915 Derbyshire
1,627,454 A * 5/1927 Phalon ..... A47B 13/14 108/18

(Continued)

FOREIGN PATENT DOCUMENTS

WO WO 2018/185693 A1 10/2018

OTHER PUBLICATIONS

Bauer Corporation, "20900 Fold-N-Go Platform 500lb Capacity", http://www.bauerladder.com/safety-ladder/20900-fold-n-go-work-platform.html, accessed Sep. 17, 2015, 1 page.

(Continued)

*Primary Examiner* — Hanh V Tran

(57) ABSTRACT

A work platform configured to be adjustable in both height and width, while enabling ease in transformation between an open, use configuration in a closed, storage configuration. The work platform having a platform and a pair of leg frames pivotably coupled to opposite ends of the platform, each of the pair of leg frames including a first leg and a second leg, each of which includes a first member pivotably coupled to the platform, and a second member shiftable relative to the first member, an intermediate rung operably coupled to respective distal ends of the first members and including a length extension lock mechanism configured to inhibit shifting of the second members relative to the first members, and a base rung member including a crossmember operably coupled to the respective distal ends of the second members.

19 Claims, 10 Drawing Sheets

Related U.S. Application Data

(60) Provisional application No. 62/621,312, filed on Jan. 24, 2018.

(51) Int. Cl.
*E04G 1/32* (2006.01)
*E04C 1/39* (2006.01)

(56) References Cited

U.S. PATENT DOCUMENTS

| | | | | |
|---|---|---|---|---|
| 2,514,524 | A | 7/1950 | Steele | |
| 2,587,177 | A | 2/1952 | Larson | |
| 2,999,729 | A | 9/1961 | Semmelroth | |
| 3,410,232 | A | 11/1968 | Bills | |
| 3,893,400 | A | 7/1975 | Grant | |
| 3,915,102 | A | 10/1975 | Barron | |
| 4,462,636 | A * | 7/1984 | Markson | A47C 16/02 108/128 |
| 5,096,019 | A | 3/1992 | Kelsay | |
| 5,332,062 | A | 7/1994 | Revere | |
| 5,368,126 | A | 11/1994 | Woodward | |
| 5,439,073 | A * | 8/1995 | Johnson | A47B 3/0818 182/153 |
| 5,678,653 | A | 10/1997 | Clinch | |
| 5,746,288 | A | 5/1998 | O'Neal | |
| D486,243 | S | 2/2004 | Yamaoka | |
| 7,516,704 | B2 | 4/2009 | Snider et al. | |
| 8,113,316 | B2 | 2/2012 | Sward | |
| 8,307,769 | B1 | 11/2012 | Wescott | |
| 9,347,263 | B2 | 5/2016 | Weston | |
| 9,512,627 | B2 | 12/2016 | Taron | |
| 9,752,334 | B2 | 9/2017 | Foley | |
| 10,012,000 | B2 | 7/2018 | Yoo | |
| 10,161,184 | B2 | 12/2018 | Lampe | |
| 10,470,561 | B2 | 11/2019 | Clegg | |
| 10,697,238 | B2 | 6/2020 | Era | |
| 2004/0238280 | A1 | 12/2004 | Gibson | |
| 2006/0130715 | A1 | 6/2006 | Yoo et al. | |
| 2006/0169539 | A1 | 8/2006 | Grebinoski et al. | |
| 2007/0101910 | A1 | 5/2007 | Haimoff | |
| 2008/0310910 | A1 | 12/2008 | Chick | |
| 2009/0065304 | A1 * | 3/2009 | Jian | E06C 7/083 182/209 |
| 2009/0078165 | A1 | 3/2009 | Tseng | |
| 2009/0078503 | A1 * | 3/2009 | Eriksson | E06C 1/22 182/18 |
| 2009/0133959 | A1 | 5/2009 | Eriksson | |
| 2009/0229918 | A1 * | 9/2009 | Moss | E06C 7/16 182/129 |
| 2010/0071996 | A1 | 3/2010 | Huang | |
| 2010/0258379 | A1 * | 10/2010 | Mickens | E06C 7/146 182/111 |
| 2011/0272213 | A1 | 11/2011 | Taron | |
| 2016/0153232 | A1 | 6/2016 | Kieffer | |
| 2017/0044780 | A1 | 2/2017 | Foley | |
| 2017/0183881 | A1 | 6/2017 | Yoo | |
| 2017/0275897 | A1 | 9/2017 | Weadward | |
| 2017/0275900 | A1 * | 9/2017 | Woodward | E04G 1/30 |
| 2018/0223597 | A1 | 8/2018 | Fischer | |

OTHER PUBLICATIONS

California Car Cover Co., "Folding Platform Ladder", http://www.calcarcover.com/product/1562/107/Folding-Platform-Ladder, accessed Sep. 17, 2015, 2 pages.

Harbor Freight, "Step Stool/Working Platform", http://www.harborfreight.com/step-stool-working-platform-66911.html, accessed Sep. 17, 2015, 1 page.

http://sell.lulusoso.com/upload/20120309/Aluminum-work-platform.jpg, accessed Sep. 17, 2015, 1 page.

http://www.canbuilt.com/images-thumb/WP-1238.jpf, accessed Sep. 17, 2015, 1 page.

Application and File History for U.S. Appl. No. 16/253,837, filed Jan. 22, 2019. Inventors: Joseph P. Foley et al. as available on PAIR at.

* cited by examiner

WORK PLATFORM

RELATED APPLICATION

This application is a continuation of application Ser. No. 16/253,837, filed Jan. 22, 2019, which claims the benefit of U.S. Provisional Application No. 62/621,312, filed Jan. 24, 2018, each of which is hereby fully incorporated herein by reference.

TECHNICAL FIELD

The present disclosure relates generally to portable work platforms, and more particularly to a collapsible work platform configured to provide a stable elevated work surface.

BACKGROUND

Professional tradespersons such as painters, drywall installers, and electricians require an elevated work surface upon which to stand to reach the location of their work. Homeowners, too, have the need for elevated platforms for various home improvement projects. Ladders and step stools are inconvenient because they have a narrow width and require continued movement to work on an area of more than a couple feet in length. Therefore, many tradespersons and homeowners use a work platform to provide elevation with extended length.

Work platforms and scaffolds are well known in the art. More recent improvements allow for increased portability and storage. One example of such a work platform is disclosed in U.S. Pat. No. 9,752,334 (assigned to Tricam Industries, Inc.), the contents of which are incorporated by reference herein. Such foldable work platforms present a significant advantage over work platforms and scaffolds of conventional designs, in that they provide superior stability and load bearing, while being easy to transform from a use configuration to a storage configuration (and vice versa) for ease in storage and portability.

Although such work platforms have performed quite well, once transformed to the use configuration, the work platform is fixed in both its height and width. Although the fixed height of the elevated work surface provides a stable platform, the fixed height may necessitate the tradesperson or homeowner having to stretch to reach the desired work area, or having to bend over or crouch to perform the desired work. Such abnormal posture, particularly for an extended period of time, can result in unnecessary fatigue and/or less than optimal performance. Further, although increases in stability of the work platform are always desirous, the width of the platform must be balanced against the ease in storage, portability, and transformation between the storage configuration and use configuration.

The present disclosure addresses these concerns.

SUMMARY OF THE DISCLOSURE

Embodiments of the present disclosure provide an improved work platform having folding leg frames that are adjustable in both height and width and are configured to elevate and support a work surface or platform, while enabling ease in transformation between an open, use configuration and a closed, storage configuration. In one embodiment, the improved work platform can be folded into a narrow profile for storage, for example, by folding the leg frames such that they are positioned within an outer perimeter of the platform in the closed, storage configuration. One or more clips can be utilized to retain the legs in the closed, storage configuration. For ease in transformation between the open, use configuration and the closed, storage configuration, the leg height and width adjustment mechanisms can be one-handed in operation. Additionally, the adjustment mechanisms can be biased to a locked position to inhibit unintentional or inadvertent changes in height or width of the work platform, particularly when subjected to vibration and other external forces during use.

The work platform can be manufactured of any formable, rigid, durable material, such as metal, plastic or fiberglass. For example, in one embodiment, the work platform can be constructed of aluminum. The elevated work surface can be constructed as a single component, or as a plurality of planks, for example of extruded aluminum. In one embodiment, the various components of the work platform can be attached by welding, rivets, screws, or other fasteners. In one embodiment, the elevated work surface can include bumper/handles positioned in proximity to the ends thereof to facilitate carrying of the work platform in both the closed, storage configuration and in the open, use configuration. In one embodiment, the bumper/handles can serve to protect one or more leg lock release mechanisms configured to lock the legs in the open, use configuration.

The work platform can include one or more leg braces/rungs configured to provide additional stability. For example, in one embodiment, the work platform can include a proximal rung member, an intermediate rung member, and a base rung member. To facilitate adjustment in height, the legs can be telescoping in nature. In one embodiment, the intermediate rung member can include a length extension lock mechanism configured to enable height adjustment of the legs. To ease in height adjustment, the length extension lock mechanism can be operated with a single hand, thereby enabling the legs to extend under the force of gravity as the work surface is held in an elevated position. Similarly, when transitioning from the open, use configuration to the closed, storage configuration, the length extension lock mechanism can be operated with the single hand, thereby enabling the work surface to naturally descend under the force of gravity as the telescoping legs shorten in length. For example, in one embodiment, the length extension lock mechanism can be a pinch lock.

The width of the work platform can be adjusted by way of one or more laterally extendable feet positioned in proximity to the distal ends of the legs. In one embodiment, the base rung member can include a width extension lock mechanism configured to enable adjustment of the laterally extendable feet. To ease in width adjustment, the width extension lock mechanism can be operated with a single hand. To inhibit changes in the width of the platform during use, the width extension lock mechanism can be biased to a locked position, particularly when subjected to vibration. To provide improved contact with the ground or supporting surface end caps can be positioned on the ends of the laterally extendable feet. In some embodiments, the end caps can be replaceable, should they become worn or otherwise unserviceable.

One embodiment of the present disclosure provides a folding work platform configured to be adjustable in both height and width, while enabling ease in transformation between an open, use configuration and a closed, storage configuration. The folding work platform can include a platform, a first leg frame and a second leg frame. The platform can have a first end, a second end, a longitudinal plane, and an outer perimeter. The first leg frame can be pivotably coupled to the platform proximal to the first end.

The second leg frame can be pivotably coupled to the platform proximal to the second end. The first and second leg frames can be configured to be adjustable relative to the platform between the open, use configuration, and the closed, storage configuration. Each of the first and second leg frames can include a pair of legs, an intermediate rung member, and a base rung member. The pair of legs can be configured to be selectively adjustable in length. Each of the legs can include a first member pivotably coupled to the platform, and a second member shiftable relative to the first member. The intermediate rung member can be operably coupled to the respective distal ends of the first members of the pair of legs, thereby serving as a first connection between the pair of legs. The intermediate rung member can include a length extension lock mechanism configured to inhibit shifting of the second members of the pair of legs relative to the first members of the pair of legs. The base rung member can be configured to be selectively adjustable in width. The base rung member can include a crossmember, a pair of laterally extendable feet, and a width extension lock mechanism. The crossmember can be operably coupled to the respective distal ends of the second members of the pair of legs, thereby serving as a second connection between the pair of legs. The pair of laterally extendable feet can be shiftable relative to the crossmember. The width extension lock mechanism can be configured to inhibit shifting of the pair of laterally extendable feet relative to the crossmember.

In one embodiment, the first and second leg frames can be configured to be positioned within the outer perimeter of the platform in the closed, storage configuration. In one embodiment, the folding work platform can further include one or more leg lock release mechanisms configured to secure the first and second leg frames in the open, use configuration. In one embodiment, the folding work platform can further include a first bumper positioned in proximity to the first end of the platform and a second bumper positioned in proximity to the second end of the platform. In one embodiment, the first and second bumpers can be configured to serve as carrying handles for the folding work platform. In one embodiment, the first and second bumpers can be configured to protect the one or more leg lock release mechanisms.

In one embodiment, the first and second leg frames can be constructed of aluminum. In one embodiment, the first member of the pair of legs can be constructed of an extruded tube having a substantially rectangular cross-section. In one embodiment, the folding work platform can further include a proximal rung member operably coupled to the first members of the pair of legs in proximity to the proximal ends thereof, thereby serving as a third connection between the pair of legs. In one embodiment, the length extension lock can be configured to be operated by a single hand of a user, thereby promoting ease in adjustability of a length of the pair of legs. In one embodiment, the length extension lock mechanism can be biased towards a locked position when subjected to vibration, thereby inhibiting inadvertent retraction or otherwise narrowing of the desired width of the pair of feet relative to the crossmember during use.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
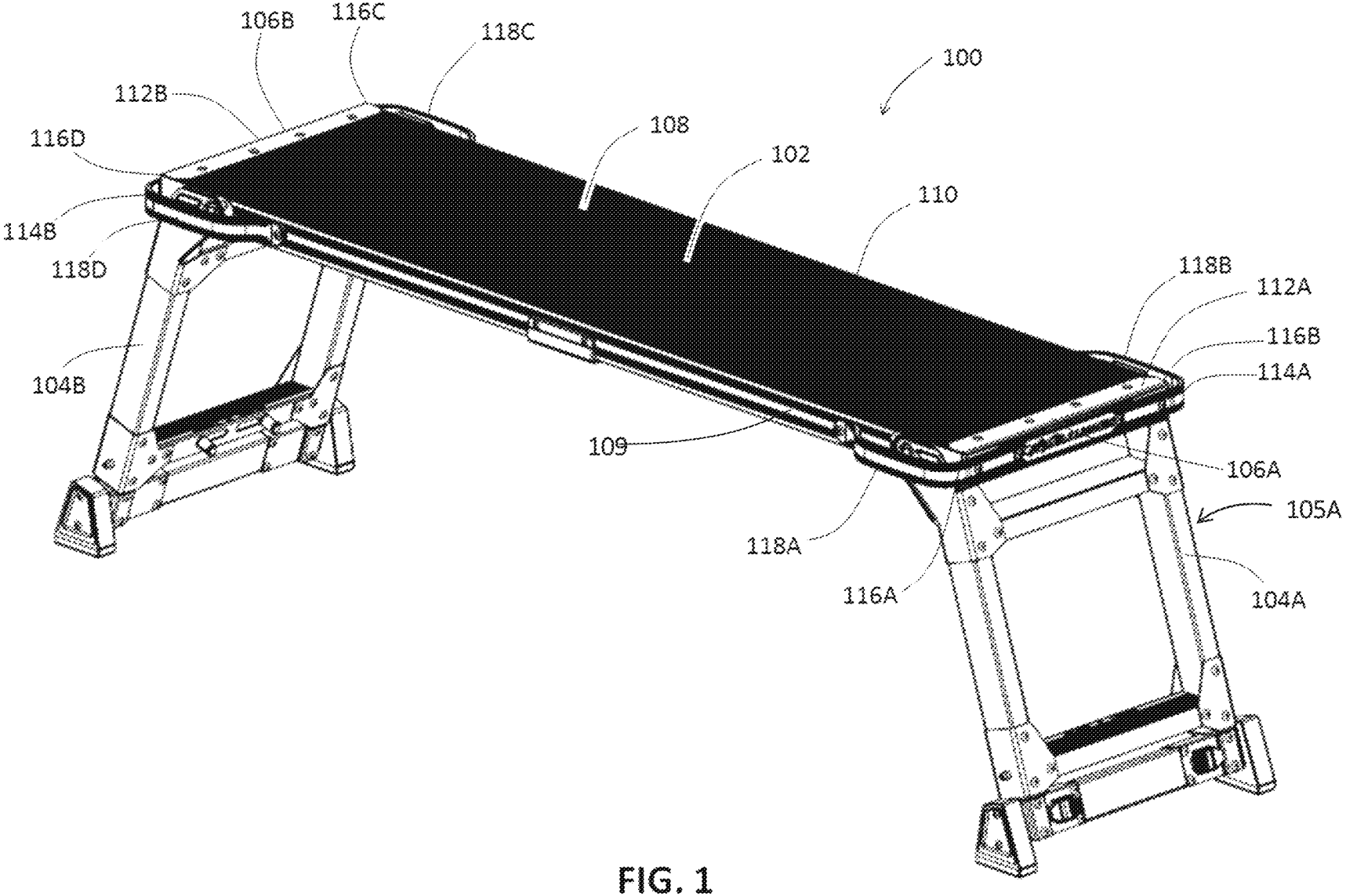
FIG. 1 is a top perspective view depicting a work platform in an open, use configuration, in accordance with an embodiment of the disclosure.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION

Figure 2:
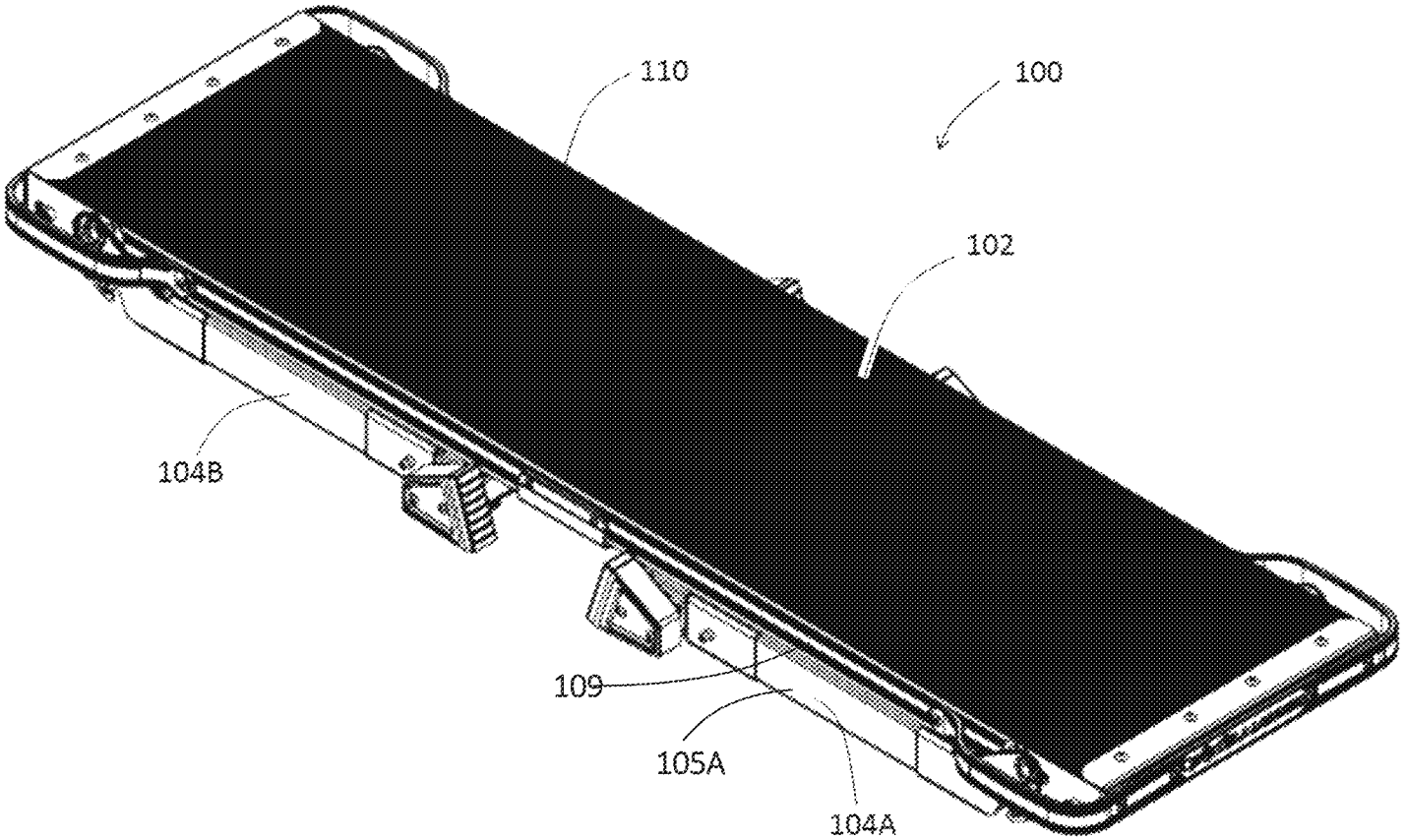
FIG. 2 is a top perspective view depicting the work platform of FIG. 1 in a closed, storage configuration.
Figure 3:
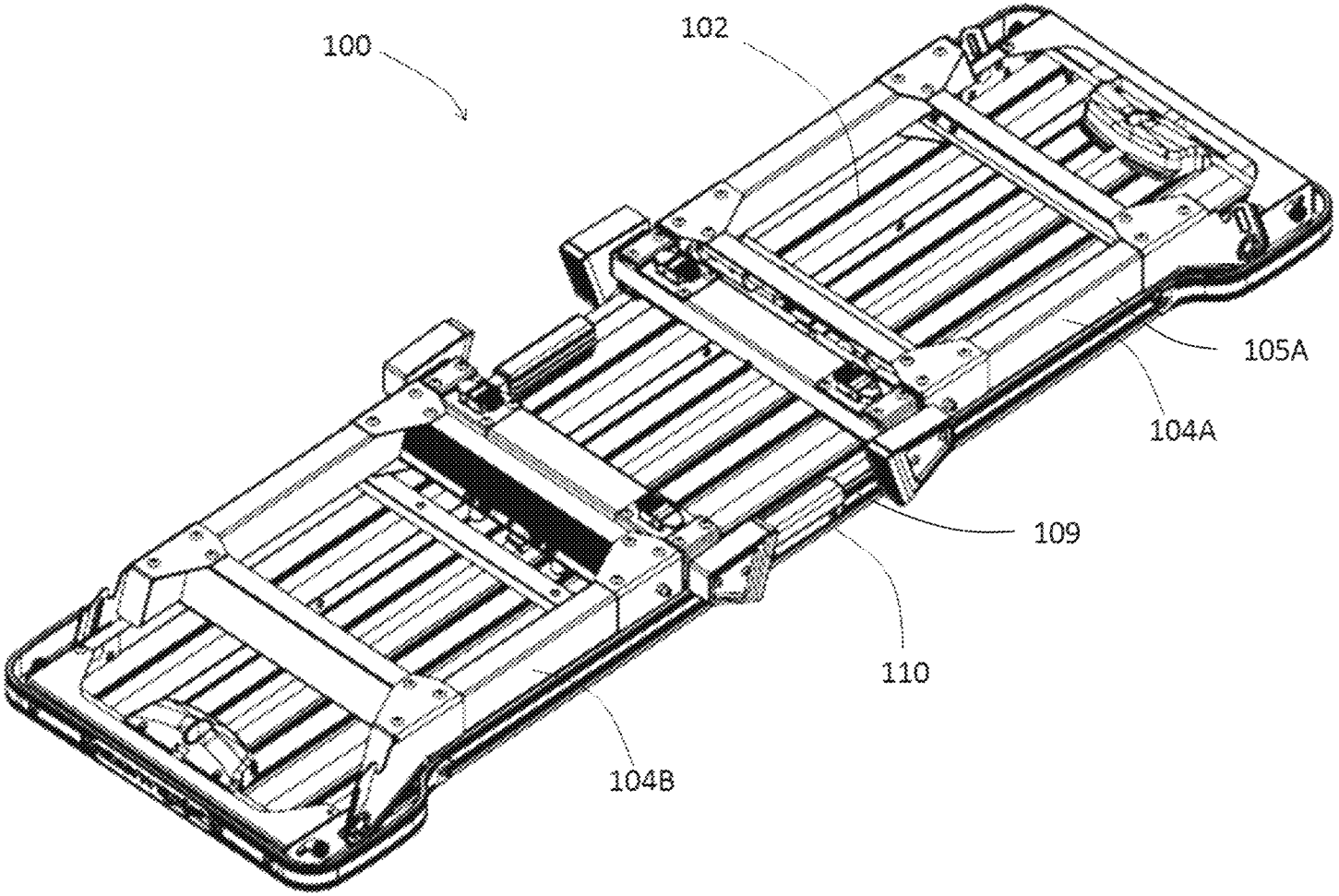
FIG. 3 is a bottom perspective view depicting the work platform of FIG. 1 in the closed, storage configuration.

Referring to FIGS. 1-3, a work platform 100 is depicted in accordance with an embodiment of the disclosure. The work platform 100 can be configured to be adjustable in both height and width, while enabling ease in transformation between an open, use configuration (as depicted in FIG. 1) and a closed, storage configuration (as depicted in FIGS. 2 and 3).

The work platform 100 can include a platform 102 (alternatively referred to as a "work surface" or "elevated work surface") and a first and second leg frame 104A and 104B pivotably coupled to the platform 102. The platform 102 can have a first end 106A, a second end 106B, and a longitudinal plane 108 defined by outer perimeter 110. In one embodiment, the platform 102 can be manufactured of any formable, rigid, durable material, such as metal, plastic or fiberglass. For example, in one embodiment, the platform 102 can be constructed of a plurality of extruded aluminum planks, operably coupled to one another by one or more brackets 112A/B positioned in proximity to the respective first end 106A and second end 106B. In some embodiments, the various components of the platform 102 can be operably coupled together via welding, rivets, screws, fasteners, or the like. To minimize the overall profile of the work platform 100 during storage and transportation, in one embodiment, the first and second leg frames 104A/B can be configured to be positioned within the confines of the outer perimeter 110 when the work platform is in the closed, storage configuration.

As illustrated in FIGS. 1-10, the platform 102 has a longitudinal outside surface 109 that is the outermost exterior structure of the platform 102 that makes up part of the platform outer perimeter 110. Similarly, each leg frame first member 130 has a longitudinal outer surface 105A that is the outermost exterior structure of the first member 130. As best seen in FIGS. 2-3 and 8, the minimization of the profile is accomplished by having the longitudinal outer surface 105A be within the platform longitudinal outside surface when the work platform 100 is in the closed, storage configuration.

This amendment does not add new matter as the description is inherent in the original disclosure, specifically in FIGS. 2-3 and 8; page 2, lines 18-21; page 5, lines 15-16; and page 9, lines 15-18. It is noted that the material that the Examiner considered to be new matter ("coplanar with") has been cancelled and applicants respectfully request entry of the present amendment.

In some embodiments, the platform 102 can include one or more bumpers 114A/B configured to protect portions of the platform 102 from potential damage during use, storage or transportation. For example, in one embodiment, the one or more bumpers 114A/B can be positioned in proximity to corners 116A-D of a generally rectangular shaped platform 102. In one embodiment, the bumpers 114A/B can be configured to wrap around a respective first end 106A and second end 106B of the platform 102. In some embodiments, the bumpers 114A/B can include one or more handgrips 118A-D for ease in maneuvering the work platform 100. For example, in one embodiment, the platform 102 can include four handgrips 118A-D, positioned in proximity to the respective four corners 116 A-D of the platform 102. In one embodiment, the one or more bumpers 114A/B can be configured to protect the pivoting connection between the first and second leg frame 104A/B and the platform 102.

Figure 4:
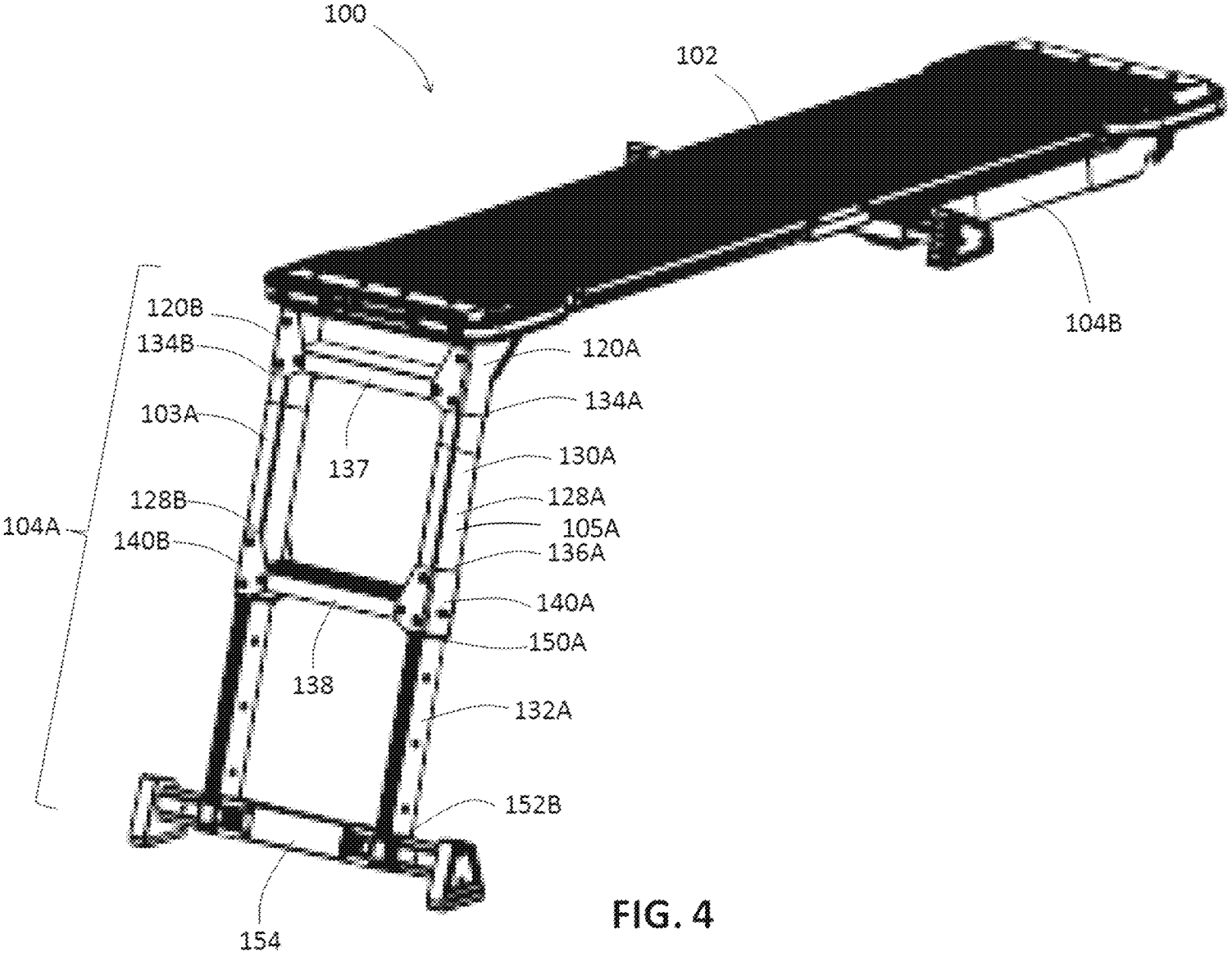
FIG. 4 is a top perspective view depicting the work platform of FIG. 1, with a first leg frame extended in an open configuration and a second leg frame folded in a closed configuration.
Figure 5B:
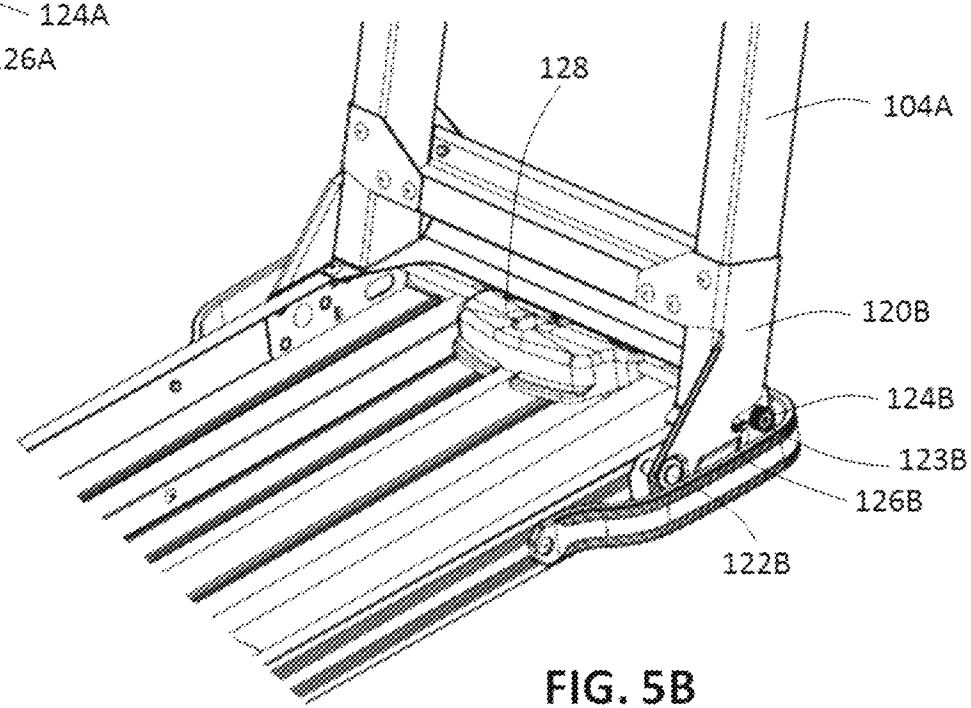
FIG. 5B is a close-up, partial, bottom perspective view depicting the pivotable connection between the platform and first leg frame of FIG. 5A.
Figure 5A:
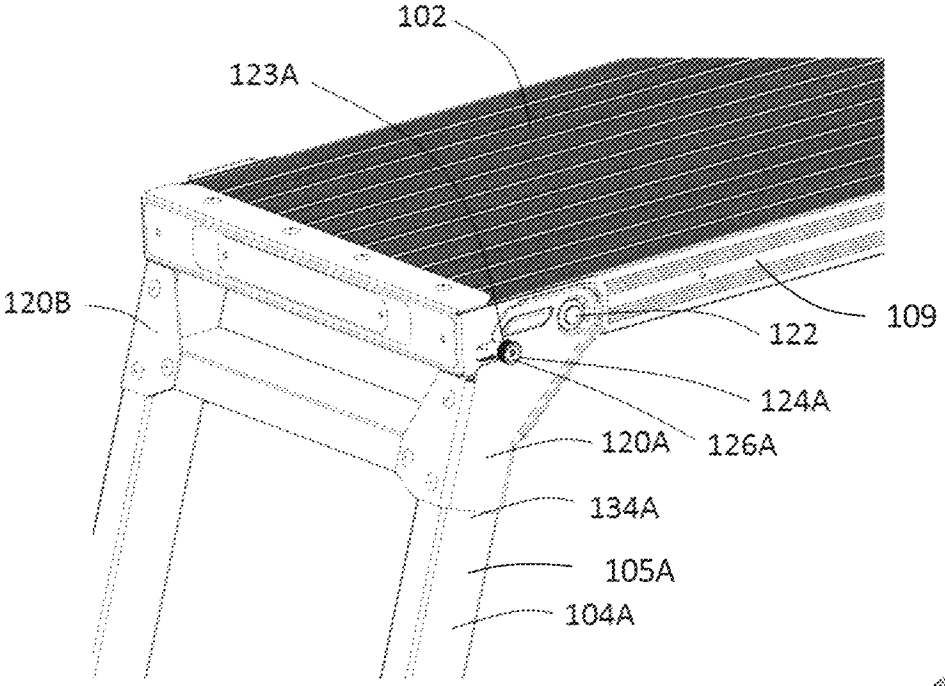
FIG. 5A is a close-up, partial, top perspective view depicting a pivotable connection between a platform and a first leg frame, in accordance with an embodiment of the disclosure.

With reference to FIG. 4, the first leg frame 104A and the second leg frame 104B are independently pivotable with respect to the platform 102 between an open position and a closed position. FIG. 4 depicts the first leg frame 104A in the open position and the second leg frame 104B in the closed position. FIGS. 5A-B depicts close-up views of the pivotable connection between the first leg frame 104A and the platform 102. In one embodiment, each leg frame 104 can include one or more brackets 120A/B having hinge pins 122A/B pivotably coupling the leg frame 104 to the platform 102. In one embodiment, the platform 102 can include one or more leg lock release mechanisms 123A/B configured to secure the leg frames 104 in the open, use configuration. For example, in one embodiment, each of the leg lock release mechanisms 123A/B can include a latch pin 124A/B configured to engage with a respective notch 126A/B defined by the one or more brackets 120A/B, thereby selectively locking the leg frame 104 in the open position relative to the platform 102. In some embodiments, the latch pins 124A/B can be biased to a locked position via one or more biasing elements, such as a spring, which can be housed in housing 128 located on the bottom of the platform 102 (as depicted in FIG. 5B). In some embodiments, the biased latch pins 124A/B can be manually moved out of the locked position to release the leg frame 104 from the open position.

Figure 6B:
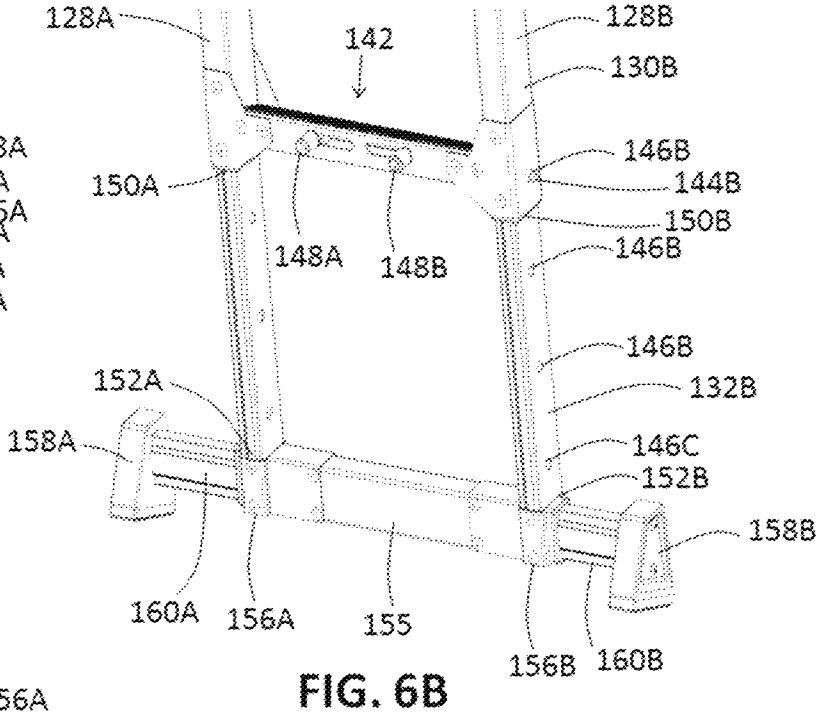
FIG. 6B is a partial, perspective inside view depicting an inner surface of the first leg frame of FIG. 6A.
Figure 6A:
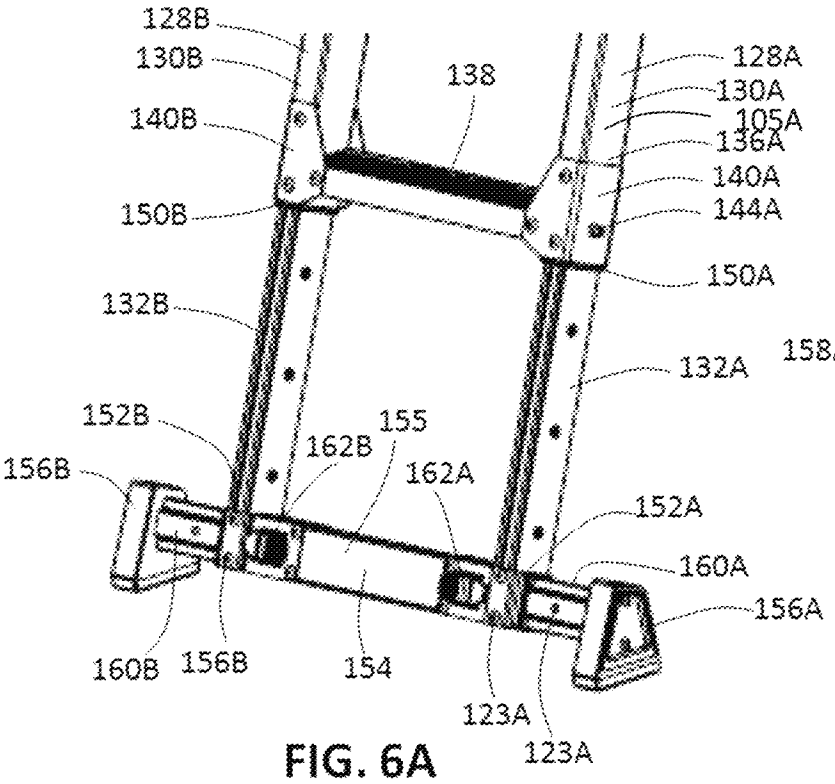
FIG. 6A is a partial, perspective view depicting an outer surface of a first leg frame, in accordance with an embodiment of the disclosure.

With additional reference to FIGS. 6A-B, each leg frame 104 can include one or more legs 128A/B configured to be selectively adjustable in length. Each leg 128A/B can include a first member 130A/B shiftably coupled to a second member 132A/B. For example, in one embodiment, each leg 128 can be telescoping, such that the second member 132 is configured to at least partially reside within the first member 130, or vice versa. In one embodiment, the first member 130 can be constructed of an extruded aluminum tube having a substantially rectangular cross-section, and the second member 132 can be constructed of a corresponding extruded aluminum tube having a cross section configured to reside within the hollow lumen of the first member 130; although other telescoping configurations are also contemplated.

With continued reference to FIG. 4, each first member 130A/B can include a proximal end 134A/B operably pivotably coupled to the platform 102, for example via bracket 120A/B, and a distal end 136A/B. In one embodiment, a proximal rung 137 can be operably coupled to the proximal ends 134A/B of each first member 130A/B, thereby serving as a stabilizing connection between the pair of legs 128A/B. An intermediate rung 138 can be operably coupled to the distal ends 136A/B of each first member 130, thereby serving as a further stabilizing connection between the pair of legs 128A/B. In one embodiment, a pair of brackets 140A/B can be utilized to operably couple the intermediate rung 138 to the first members 130A/B.

With continued reference to FIG. 6A-B, in one embodiment, the intermediate rung 138 can include a length extension lock mechanism 142 configured to inhibit unintended changes in length of the legs 128A/B by a shifting of the second members 132A/B relative to the first members 130A/B. For example, in one embodiment, the length extension lock mechanism 142 can include one or more pins 144A/B configured to traverse through respective apertures defined in each of the respective first member 130 and second member 132. In some embodiments, a plurality of apertures 146A-D corresponding to selectable heights (as depicted in FIG. 6B), can be defined in the second member 132.

In some embodiments, the one or more pins 144A/B can be biased into a locked position via one or more biasing elements, and shiftable away from the locked position via one or more handles 148. In one embodiment, the length extension lock mechanism 142 can include a pair of handles 148A/B configured to enable manual shifting of the one or more pins 144A/B away from the biased locked position. In one embodiment, the pair of handles 148A/B can be positioned in proximity to one another to form a pinch lock, such that both handles 148A/B can be simultaneously manipulated (or otherwise shifted away from the locked position) with a single hand of a user, thereby easing in adjustment of the length of the legs 128.

With continued reference to FIG. 6A-B, each second member 132A/B can include a proximal end 150A/B in communication with the first member 130A/B, and a distal end 152A/B. A base rung 154 can be operably coupled to the distal ends 152A/B of each second member 132A/B, thereby serving as a stabilizing connection between the pair of legs 128A/B. In one embodiment, a pair of brackets 156A/B can be utilized to operably couple the base rung 154 to the second members 132A/B.

In one embodiment, the width of the base rung 154 can be adjusted by way of one or more laterally extendable feet 156A/B configured to be shifted relative to a crossmember 155. For example, in one embodiment, each laterally extendable foot 156 can include an end cap member 158A/B configured to make contact with the ground or other supporting surface, and an extension member 160A/B configured to telescopically connect the crossmember 155. In some embodiments, the end cap member 158A/B can be replaceable, should they become worn or otherwise unserviceable.

In one embodiment, the one or more laterally extendable feet 156A/B can be selectively locked in position relative to the crossmember 155 by way of one or more width extension lock mechanisms 162A/B. For example, in one embodiment, each width extension lock mechanism 162 can include a pin configured to selectively engage with a corresponding aperture defined within each extension member 160. In some embodiments, a plurality of apertures 164, corresponding to selectable widths, can be defined in the extension member 160. In some embodiments, the width extension lock mechanism 162 can be biased to a locked position, thereby inhibiting unintentional changes in width when the work platform 100 is subjected to vibration or other external forces.

In operation, the respective leg frames 104A/B are configured to enable ease in transition from the storage configuration to the use configuration, as well as ease in adjustment of both the height and width of the work platform. In the storage configuration (as depicted in FIGS. 2-3), the leg frames 104A/B can be collapsed in both length and width, such that respective laterally extendable feet 156 of the leg frames are generally positioned within the outer perimeter 110 of the platform 102, so as to minimize the space required to store the work platform 100. One or more clips (not depicted) can be utilized to retain the legs in the closed, storage configuration.

Figures 7A, 7B, 7C:
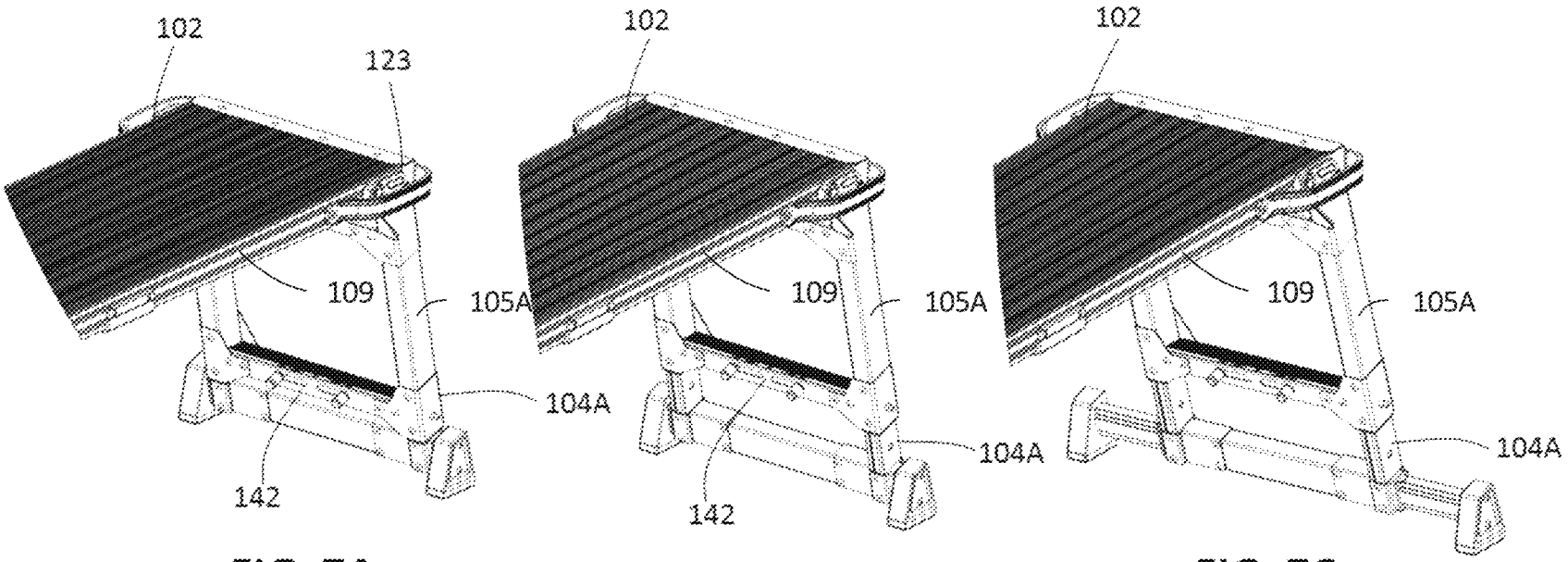
FIG. 7A is a partial, perspective view depicting a portion of a work platform with a first leg frame extended in an open, use configuration, in accordance with an embodiment of the disclosure.
FIG. 7B is a partial perspective view depicting the work platform of FIG. 7A, with telescoping legs of the leg frame extended in length.
FIG. 7C is a partial perspective view depicting the work platform of FIG. 7B, with laterally extending feet of the leg frame extended in width.
Figure 8B:
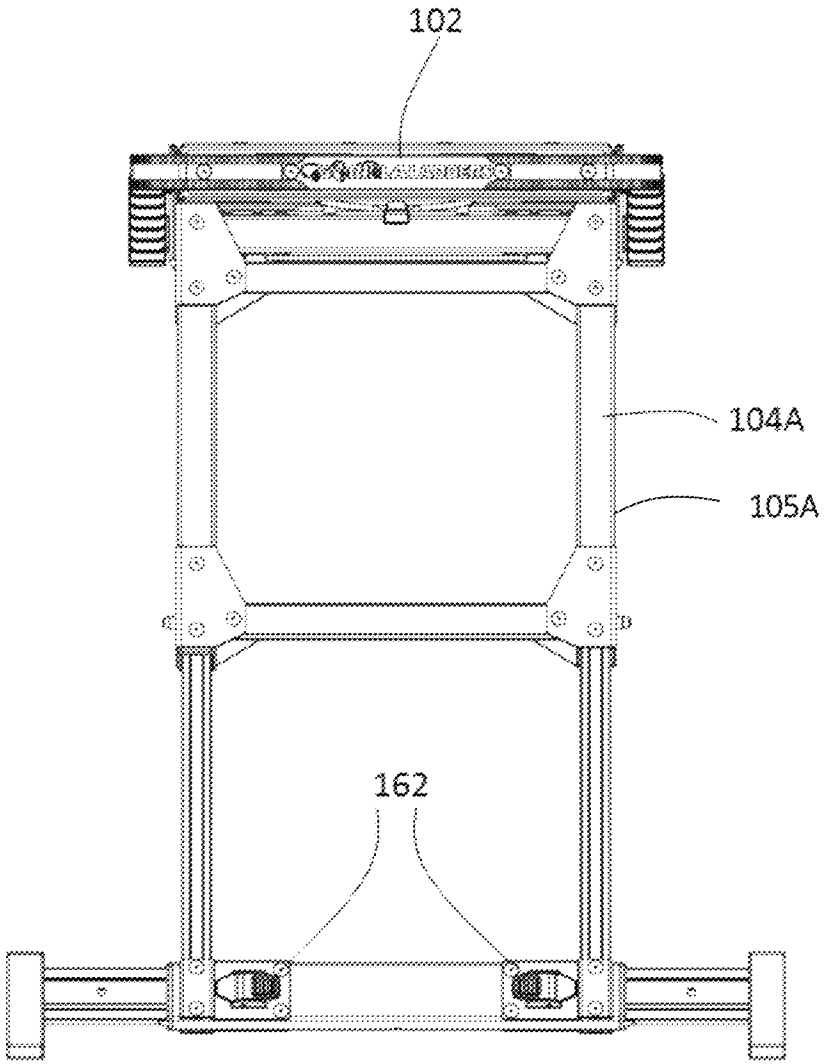
FIG. 8B is a side view of the work platform of FIG. 8A, with the laterally extending feet of the pair of leg frames extended in width.
Figure 8A:
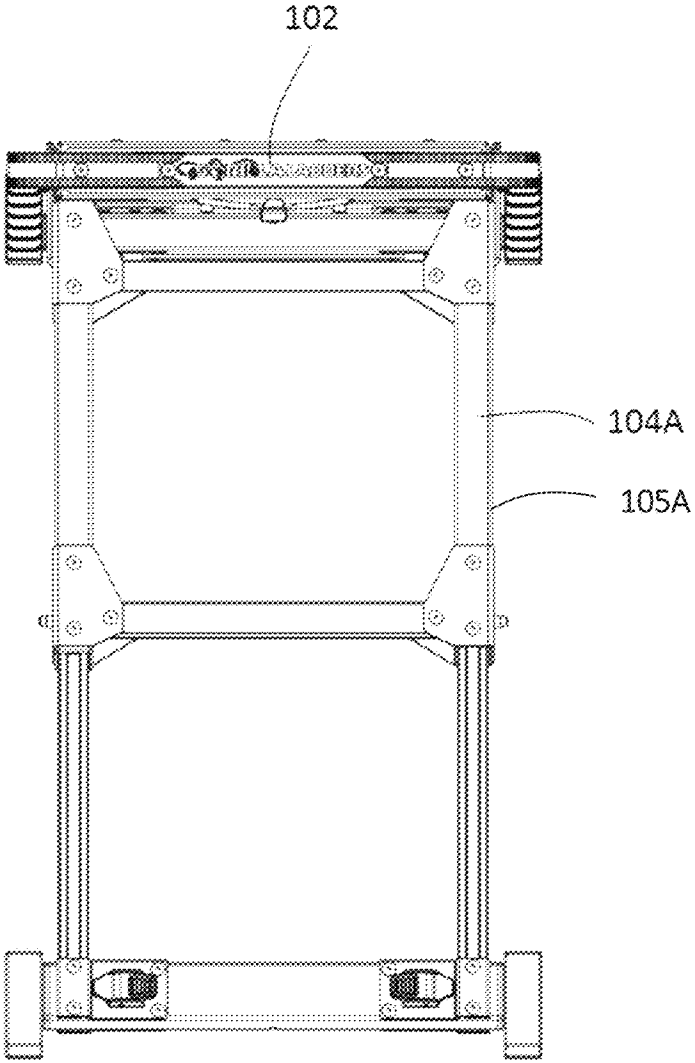
FIG. 8A is a side view depicting a work platform with a pair of leg frames extended to an open, use configuration, and with the legs of the pair of leg frames extended in length, in accordance with an embodiment of the disclosure.
Figure 9B:
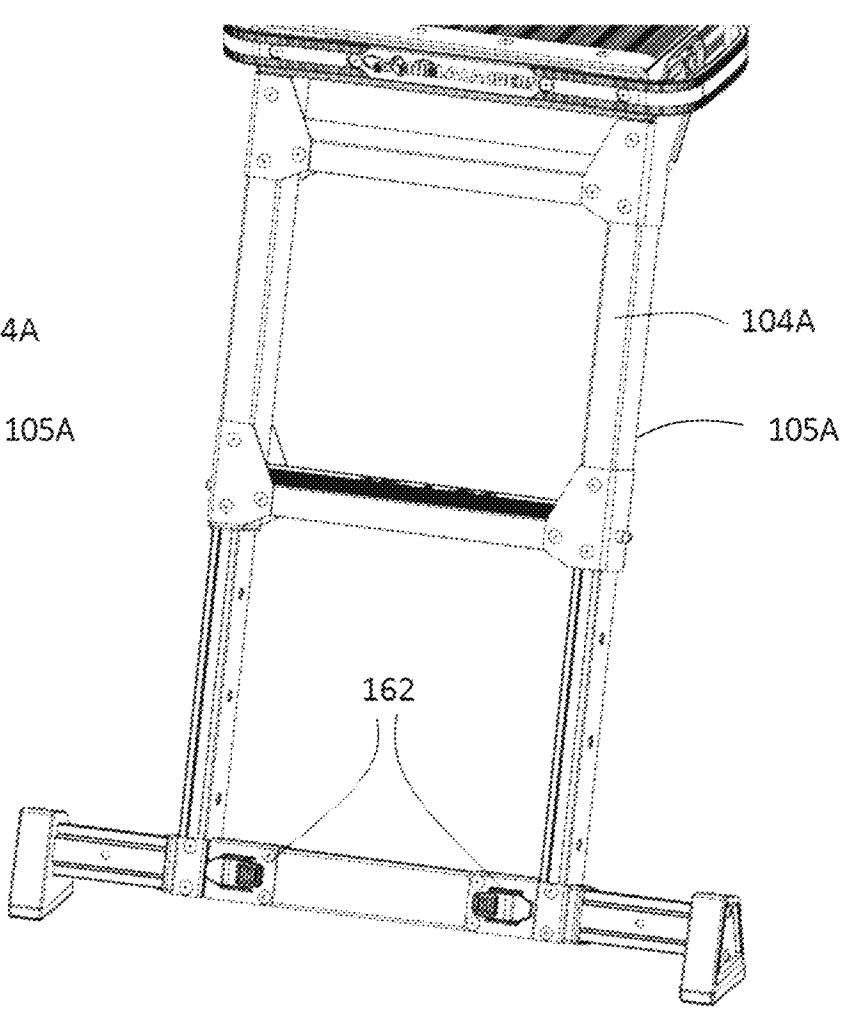
FIG. 9B is a partial, perspective view of the work platform of FIG. 9A, with the laterally extending feet of the first leg frame extended in width.
Figure 9A:
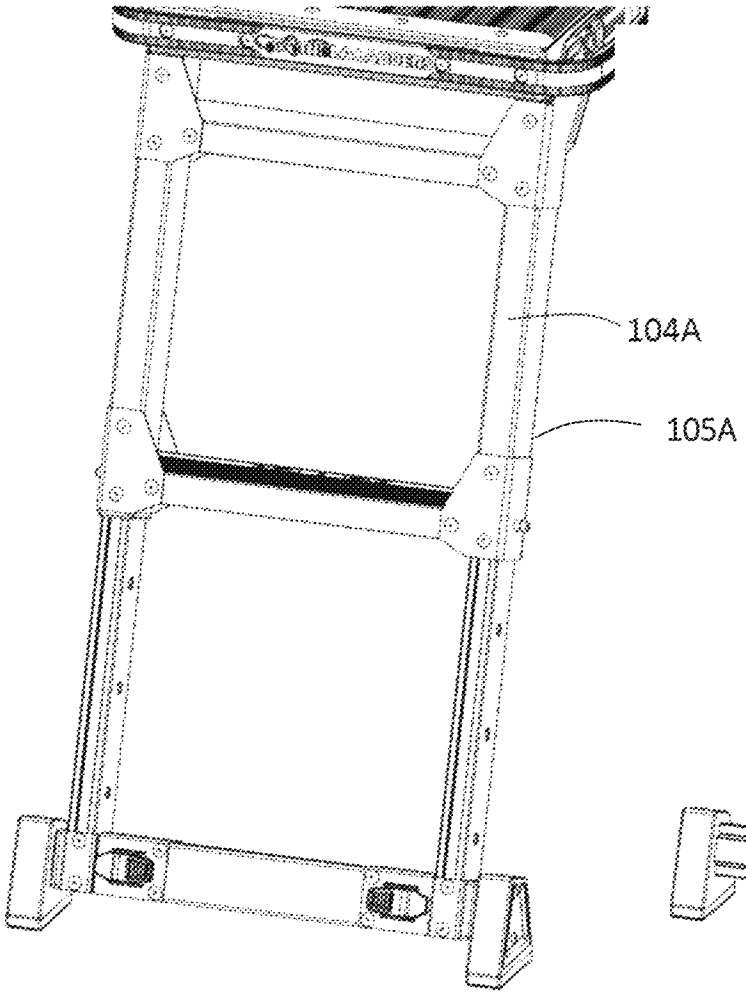
FIG. 9A is a partial, perspective view depicting a work platform with a first leg frame extended to an open, use configuration, and with the legs of the first leg frame extended in length, in accordance with an embodiment of the disclosure.
Figure 10B:
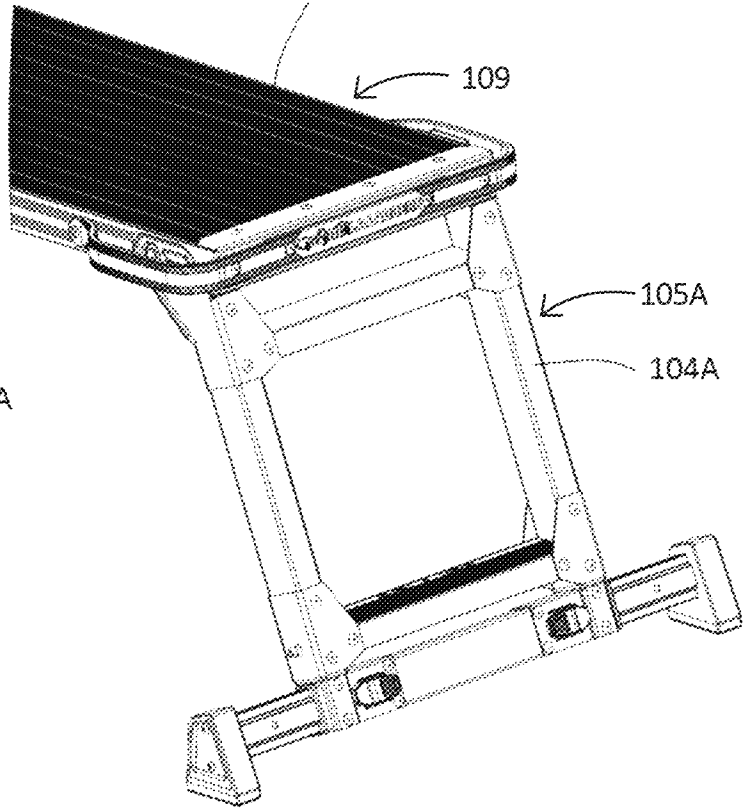
FIG. 10B is a partial, perspective view of the work platform of FIG. 10A, with the laterally extending feet of the first leg frame extended in width.
Figure 10A:
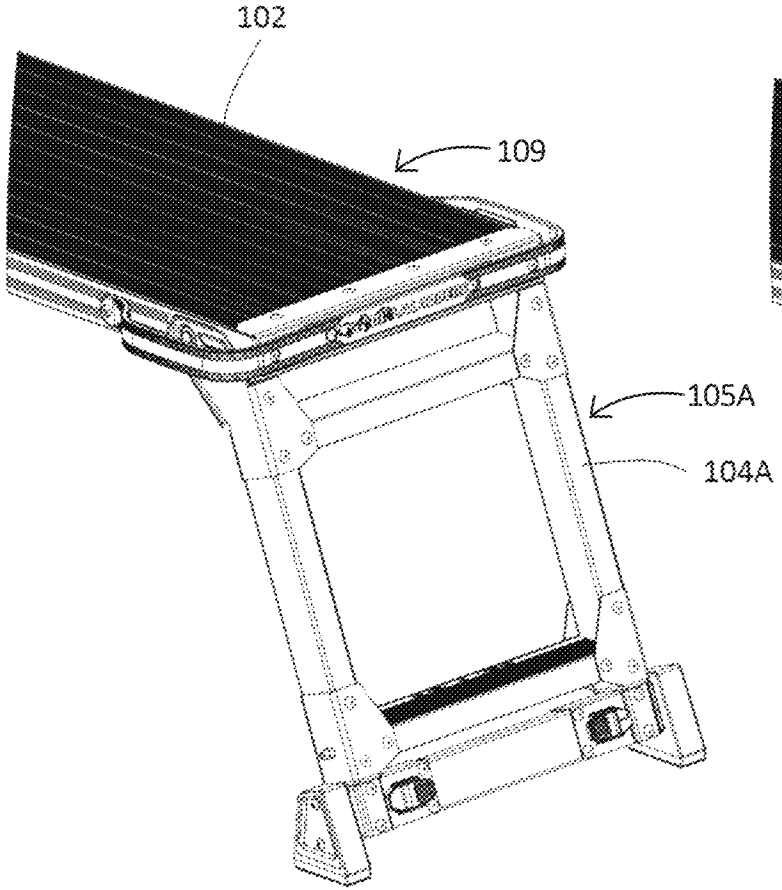
FIG. 10A is a partial, perspective view depicting a work platform with a first leg frame extended to an open, use configuration, in accordance with an embodiment of the disclosure.

With additional reference to FIGS. 7A-C, when use of the work platform 100 is desired, each of the leg frames 104 can be pivoted with respect to the platform 102 to an open position. FIG. 7A depicts a leg frame 104 pivoted with respect to the platform 102 to an open position. The one or more leg lock release mechanisms 123, can serve to inhibit the leg frame 104 from unintentionally pivoting back to the closed position.

The height of each leg frame 104 can be adjusted by manually shifting one or more length extension lock mechanisms 142, while suspending the platform 102 above the ground or other supporting surface, thereby enabling the legs 104 to extend under the force of gravity. FIG. 7B depicts a leg frame 104 extended in length. To ease in adjustment of the height, in some embodiments, the one or more length extension lock mechanisms 142 can be manipulated with a single hand. The one or more length extension lock mechanisms 142 can be biased to a locked position, thereby inhibiting unintentional changes in the overall length of the leg frames 104.

The width of each leg frame 104 can be adjusted by manually shifting the one or more width extension lock mechanisms 162 (as depicted in FIG. 6A) with one hand, while manually adjusting the laterally extendable foot 156 with the other hand. FIG. 7C depicts a leg frame 104 extended in width. The one or more width extension lock mechanisms 162 can be biased to a locked position, thereby inhibiting unintentional changes in the overall width of the leg frames 104.

FIGS. 8A-B, 9A-B, and 10A-B depict alternative configurations of embodiments of the work platform 100. Naturally biasing the various locking mechanisms (e.g., the leg lock release mechanism 123, length extension lock mechanism 142, and with extension lock mechanism 162) to the locked position can inhibit unintentional movement of the leg frames 104, particularly when subjected to vibration and other external forces during use, thereby providing a stable and dependable platform.

It should be understood that the individual steps used in the methods of the present teachings may be performed in any order and/or simultaneously, as long as the teaching remains operable. Furthermore, it should be understood that the apparatus and methods of the present teachings can include any number, or all, of the described embodiments, as long as the teaching remains operable.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

We claim:

1. A folding work platform, comprising:

a platform having a first end, a second end, a longitudinal plane, an outer perimeter, and a longitudinal outside surface;

a first leg frame pivotably coupled to the platform proximal to the first end by a bracket disposed at least partially outside the platform longitudinal outside surface and a second leg frame pivotably coupled to the platform proximal to the second end, the first and second leg frames configured to be adjustable relative to the platform between an open configuration and a closed configuration, the first and second leg frames each comprising:

a pair of legs configured to be selectively adjustable in length, each of the legs including a first member pivotably coupled to the platform and having a longitudinal outer surface, and a second member shiftable relative to the first member; and an intermediate rung member having a stepping surface and an interior surface orthogonal to and adjacent to the stepping surface operably coupled to respective distal ends of the first members of the pair of legs, thereby serving as a first connection between the pair of legs, the intermediate rung member including a length extension lock mechanism located on the interior surface comprising pins extending through the first members configured to inhibit shifting of the second members of the pair of legs relative to the first members of the pair of legs;

a proximal rung member operably coupled to the first members of the pair of legs proximate where the first members are pivotably coupled to the platform; and wherein the first member longitudinal outer surface is within the platform longitudinal outside surface when the platform is in the closed configuration.

2. The folding work platform of claim 1, wherein the first and second leg frames are configured to be positioned within the outer perimeter of the platform in the closed configuration.

3. The folding work platform of claim 1, further comprising one or more leg lock release mechanisms configured to secure the first and second leg frames in the open configuration.

4. The folding work platform of claim 3, further comprising a first bumper positioned in proximity to the first end of the platform and a second bumper positioned in proximity to the second end of the platform.

5. The folding work platform of claim 4, wherein the first bumper and second bumper are configured to serve as a handle and to protect the one or more leg lock release mechanisms.

6. The folding work platform of claim 1, wherein the first and second leg frames are constructed of aluminum.

7. The folding work platform of claim 2, wherein the first member of the pair of legs is constructed of an extruded tube having a substantially rectangular cross section.

8. The folding work platform of claim 1, further comprising feet operably coupled to respective distal ends of the leg second members.

9. The folding work platform of claim 1, wherein the length extension lock mechanism is configured to be operated with a single hand, thereby promoting ease in adjusting a length of the pair of legs.

10. The folding work platform of claim 1, wherein the length extension lock mechanism is biased towards a locked position when subjected to vibration, thereby inhibiting inadvertent change in leg length during use.

11. The folding work platform device of claim 1, wherein the length extension lock mechanism is configured to be operated with a single hand.

12. The folding work platform device of claim 1, wherein the length extension lock mechanism is biased towards a locked position when subjected to vibration.

13. A work platform device, comprising:

a platform having a longitudinal outside surface;

a pair of leg frames pivotably coupled to opposite ends of the platform by a bracket disposed at least partially outside the platform longitudinal outside surface, the pair of leg frames adjustable relative to the platform between a use configuration and a storage configuration, each of the pair of leg frames comprising:

a first leg and a second leg, each of the first and second leg including a first member pivotably having an longitudinal outer surface coupled to the platform, and a second member shiftable relative to the first member;

an intermediate rung member having a stepping surface and an interior surface orthogonal to and adjacent to the stepping surface operably coupled to respective distal ends of the first members and including a length extension lock mechanism located on the interior surface comprising pins extending through the first members configured to inhibit shifting of the second members relative to the first members; and a proximal rung member operably coupled to the first members of the pair of legs proximate where the first members are pivotably coupled to the platform; and wherein the first member longitudinal outer surface is within the platform longitudinal outside surface when the platform is in the storage configuration.

14. The work platform of claim 13, wherein the pair of leg frames are configured to be positioned within an outer perimeter of the platform in the stored configuration.

15. The work platform of claim 13, further comprising one or more leg lock release mechanisms configured to secure pair of leg frames in the use configuration.

16. The work platform of claim 15, further comprising a first bumper and a second bumper positioned in proximity to the opposite ends of the platform.

17. The work platform of claim 16, wherein the first bumper and second bumper are configured to protect the one or more leg lock release mechanisms.

18. The work platform of claim 16, wherein the first bumper and second bumper are configured to serve as carrying handles for the work platform.

19. A folding work platform device configured to be adjustable in height, while enabling ease in transformation between an open, use configuration and a closed, storage configuration, the folding work platform comprising:

a platform having a first end, a second end, a longitudinal plane, an outer perimeter, and an longitudinal outside surface;

a first leg frame pivotably coupled to the platform by a bracket disposed at least partially outside the platform outer perimeter proximal to the first end and a second leg frame pivotably coupled to the platform proximal to the second end, the first and second leg frames configured to be adjustable relative to the platform between the open, use configuration and the closed, storage configuration, wherein the first and second leg frames are configured to be positioned within the outer perimeter of the platform in the closed, storage configuration, each comprising:

a pair of legs configured to be selectively adjustable in length, each of the legs including a first member comprising an longitudinal outer surface pivotably coupled to the platform, and a second member shiftable relative to the first member;

an intermediate rung member having a stepping surface and an interior surface orthogonal to and adjacent to the stepping surface operably coupled to respective distal ends of the first members of the pair of legs, thereby serving as a first connection between the pair of legs, the intermediate rung member including a length extension lock mechanism located on the interior surface comprising pins extending through the first members configured to inhibit shifting of the second members of the pair of legs relative to the first members of the pair of legs, wherein the length extension lock mechanism is configured to be operated with a single hand of a user, thereby promoting ease in adjusting a length of the pair of legs; and a proximal rung member operably coupled to the first members of the pair of legs in proximity to proximal ends thereof, thereby serving as a second connection between the pair of legs;

wherein the first member longitudinal outer surface is within the platform outside surface longitudinal when the platform is in the closed, storage configuration.

* * * * *